US005346756A

United States Patent [19]

Ogale et al.

[11] Patent Number: 5,346,756

[45] Date of Patent: Sep. 13, 1994

[54] NONWOVEN TEXTILE MATERIAL FROM BLENDS OF PROPYLENE POLYMER MATERIAL AND OLEFIN POLYMER COMPOSITIONS

[75] Inventors: Kumar Ogale, New Castle County; Michael E. Starsinic, Cecil County, both of Del.

[73] Assignee: Himont Incorporated, Wilmington, Del.

[21] Appl. No.: 968,766

[22] Filed: Oct. 30, 1992

[51] Int. Cl.[5] ..... D03D 3/00; D04H 1/58; D02G 3/00; C08L 23/04

[52] U.S. Cl. ..... 428/288; 428/280; 428/296; 428/365; 525/240

[58] Field of Search ..... 428/280, 288, 293, 364, 428/365, 296; 525/240

[56] References Cited

U.S. PATENT DOCUMENTS

| | | | |
|---|---|---|---|
| 4,087,485 | 5/1978 | Huff | 525/240 |
| 4,211,819 | 7/1980 | Kunimune et al. | 428/374 |
| 4,351,930 | 9/1982 | Patnaik | 526/125 |
| 4,634,739 | 1/1987 | Vassilatos | 525/240 |
| 4,634,740 | 1/1987 | Fujita et al. | 525/240 |
| 4,748,206 | 5/1988 | Nogiwa et al. | 525/88 |
| 4,766,178 | 8/1988 | Hwo | 525/240 |
| 4,774,292 | 9/1988 | Thiersault et al. | 525/240 |
| 4,804,577 | 2/1989 | Hazelton et al. | 428/224 |
| 4,839,228 | 6/1989 | Jezic et al. | 525/240 |
| 4,842,930 | 6/1989 | Schinkel et al. | 428/349 |
| 4,871,813 | 10/1989 | Senez | 525/240 |
| 4,874,666 | 10/1989 | Kubo et al. | 525/240 |
| 5,212,246 | 5/1993 | Ogale | 525/240 |

*Primary Examiner*—George F. Lesmes
*Assistant Examiner*—Kathryne E. Shelborne

[57] ABSTRACT

Disclosed is a nonwoven textile material comprising fibers of a propylene polymer material blended with an olefin polymer material.

10 Claims, 3 Drawing Sheets

NONWOVEN TEXTILE MATERIAL FROM BLENDS OF PROPYLENE POLYMER MATERIAL AND OLEFIN POLYMER COMPOSITIONS

FIELD OF THE INVENTION

This invention relates to nonwoven textile material comprising fibers formed from a blend of a propylene polymer material with olefin polymer materials.

BACKGROUND OF THE INVENTION

Nonwoven textile material containing various thermoplastic fibers are well-known in the prior art. In addition to its significant use in structural elements such as molded parts, polypropylene has found significant use as a fiber in yarn, and woven and nonwoven textile materials. In order to capitalize on its strength, high melting point and chemical inertness, as well as low cost, the polymer typically used for such applications has been crystalline homopolymer polypropylene. However, textile materials, such as nonwoven materials, prepared from polypropylene fibers do not generally exhibit the delicate balance of properties that would be most desirable, such as softness and drapability.

SUMMARY OF THE INVENTION

It has now been found that nonwoven textile materials prepared from fibers formed from a propylene polymer material blended with an olefin polymer material having a lower melting point than that of the propylene polymer material employed, the above mentioned and other disadvantages of earlier and present nonwoven textile materials can be avoided or reduced.

Accordingly, this invention provides a nonwoven textile material having improved strength, drapability, softness and bonding performance comprising fibers which are comprised of a blend of (A) a propylene polymer material selected from the group consisting essentially of a crystalline propylene homopolymer or a copolymer of propylene with ethylene, and (B) an olefin polymer material selected from the group consisting essentially of:

(1) a random propylene terpolymer consisting essentially of:
  (a) from 85 to 96% propylene,
  (b) from 1.5 to 5% ethylene, and
  (c) from 2.5 to 10% $C_{4-8}$ alpha-olefins;

(2) a propylene polymer composition consisting essentially of:
  (a) from 30 to 65% of a copolymer of propylene with a $C_{4-8}$ alpha-olefin containing from 80 to 98% propylene, and
  (b) from 35 to 70% of a co- or terpolymer of propylene with ethylene and, optionally, a $C_{4-8}$ alpha-olefin;

(3) a propylene polymer composition consisting essentially of:
  (a) from 30 to 60% of linear low density polyethylene (LLDPE), and
  (b) from 40 to 70% of one or more crystalline copolymers of propylene with one or more comonomers selected from ethylene or $C_{4-8}$ alpha-olefins or combinations thereof; and (4) a propylene polymer composition consisting essentially of:
  (a) from 10 to 50% of a propylene polymer having an isotactic index of greater than 80, or a copolymer of propylene with ethylene or a $C_4$–$C_8$ alpha-olefin or combinations thereof, containing over 80% propylene and having an isotactic index greater than 80,
  (b) from 5 to 20% of a semi-crystalline copolymer fraction, which copolymer is insoluble in xylene at room or ambient temperature, and
  (c) from 40 to 80% of a copolymer fraction of ethylene with propylene or a $C_4$–$C_8$ alpha-olefin or combinations thereof, and optionally with minor amounts of a diene, said copolymer fraction containing less than 40% ethylene or a $C_4$–$C_8$ alpha-olefin or combinations thereof, being soluble in xylene at room temperature and having an intrinsic viscosity from 1.5 to 4 dl/g, wherein the total of the (b) and (c) fractions, based on the total olefin polymer composition, being from about 50% to 90%, and the weight ratio of (b)/(c) being less than 0.4.

DETAILED DESCRIPTION OF THE INVENTION

Figure 1:
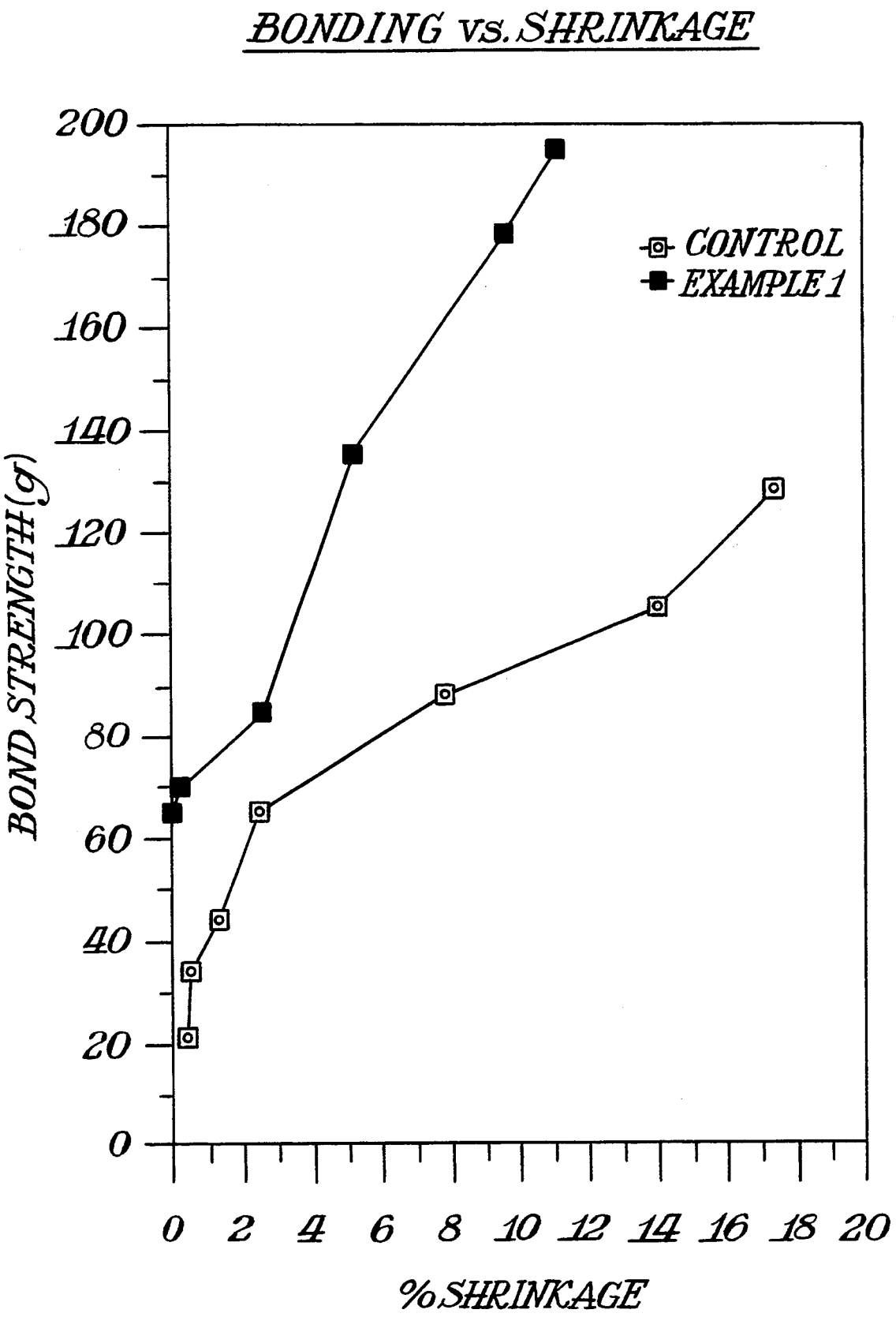
FIG. 1 is a plot showing the relationship between fiber bonding and fiber shrinkage as a function of temperature between control 1, crystalline propylene homopolymers, and Example 1 of the present invention, a blend of 90% crystalline propylene homopolymer and 10% an olefin polymer containing 25% propylene-ethylene copolymer and 75% ethylene-propylene copolymer, visbroken to a MFR of 40.

All percentages and parts in this application are by weight unless stated otherwise.

Component (A) used in the present invention can be a crystalline propylene homopolymer having an isotactic index of greater than 90, preferably greater than 96, or a copolymer of propylene with ethylene having an isotactic index of greater than 85, and an ethylene content of less than 10%, preferably less than 5%.

The olefin polymer material, component (B), used in the present invention is selected from the group consisting essentially of:

(1) a random propylene terpolymer consisting essentially of:
  (a) from 85 to 96% propylene, preferably from about 90 to 95%, most preferably from about 92 to 94%,
  (b) from 1.5 to 5% ethylene, preferably from about. 2 to 3%, and most preferably from about 2.2 to 2.7%, and (c) about 2.5 to 10% of a $C_{4-8}$ alpha-olefin, preferably from about 4 to 6%, and most preferably from about 4.4 to 5.6%, wherein the total comonomer concentration with propylene is from about 4 to 15%;

(2) a propylene polymer composition consisting essentially of:

(a) from 30 to 65%, preferably from about 45 to 65%, of a copolymer of propylene with a $C_{4-8}$ alpha-olefin, which contains from 80 to 98% propylene, and preferably from 85 to 95%, and (b) from about 35 to 70%, preferably from about 35 to 55%, of a co- or terpolymer of propylene with ethylene and, optionally, a $C_{4-8}$ alpha-olefin, wherein when (b) is a terpolymer the total comonomer content, i.e of ethylene and a $C_{4-8}$ alpha-olefin, is from 2 to 10%, preferably 3 to 6%, and the ethylene content is preferably from 1 to 3% and when (b) is a copolymer, ethylene is preferably present in an amount of from 7 to 9%;

(3) a propylene polymer composition consisting essentially of:

(a) from 30 to 60%, preferably from 40 to 60%, of linear low density polyethylene (LLDPE) having a melt index E (MIE according to ASTM D-1238) ranging from 0.1 to 15, preferably from 0.5 to 5, a density of from about 0.94 to 0.90, preferably from about 0.94 to 0.91, most preferably from about 0.93 to 0.915, and contains preferably from about 3 to 20%, most preferably from 5 to 15%, of one or more comonomers selected form $C_3$–$C_{12}$, preferably from $C_4$–$C_8$ alpha-olefins, and (b) from 40 to 70%, preferably from 40 to 60%, of one or more crystalline copolymer of propylene with one or more comonomer, selected from ethylene or $C_{4-8}$ alpha-olefins or combinations thereof, wherein the comonomer, or comonomers, content is from 5 to 20%, preferably from 8 to 15%, wherein the content of extractables in n-hexane at 50° C. is less than 7%, preferably less than 5.5% and most preferably less than 3%; and (4) a propylene polymer composition consisting essentially of:

(a) from 10 to 50% of a propylene homopolymer, preferably from 10 to 40%, and most preferably from 20 to 35%, having an isotactic index preferably from 85 to 98%, or a copolymer selected from the group consisting of (i) propylene and ethylene, (ii) propylene, ethylene and a $CH_2{=}CHR$ alpha-olefin, where R is a $C_{2-8}$ straight or branched alkyl, and (iii) propylene and an alpha-olefin as defined above in (a)(ii), wherein said copolymer contains preferably from 90 to 99% propylene and having an isotactic index greater than 80, (b) from 5 to 20% of a semi-crystalline, essentially linear copolymer fraction, preferably from 7 to 15%, having a crystallinity of about 20 to 60%, by differential scanning calorimetry (DSC), wherein the copolymer is selected from the group consisting of (i) ethylene and propylene containing over 55% ethylene; (ii) ethylene, propylene, and an alpha-olefin as defined above in (a)(ii) containing from 1 to 10% of the alpha-olefin and over 55% up to 98%, preferably from 80 to 95%, of both ethylene and alpha-olefin; and (iii) ethylene and an alpha-olefin, as defined in (a)(ii) containing over 55% up to 98%, preferably from 80 to 95%, of said alpha-olefin, which copolymer is insoluble in xylene at room or ambient temperature, and (c) from 40 to 80% of a copolymer fraction, preferably 50 to 70%, selected from the group consisting of a copolymer of (i) ethylene and propylene wherein the copolymer contains from 20% to less than 40%, preferably from 20 to 38%, most preferably 25 to 38% ethylene; (ii) ethylene, propylene, and an alpha-olefin as defined in (a)-(ii) wherein the alpha-olefin is present in an amount of from 1 to 10%, preferably from 1 to 5%, and the amount of ethylene and alpha-olefin present is from 20% to less than 40%; and (iii) ethylene and an alpha-olefin as defined in (a)(ii) containing from 20 to less than 40%, preferably 20 to 38%, and most preferably 25 to 38% of the alpha-olefin, and optionally with 0.5 to 10%, preferably 1 to 5% of a diene, said copolymer fraction being soluble in xylene at ambient temperature, and having an intrinsic viscosity preferably of from 1.7 to 3.0 dl/g. The total amount of (b) and (c) fractions, based on the total olefin polymer composition is preferably from about 65% to 80%, the weight ratio of (b)/(c) is preferably from 0.1 to about 0.3 and the total amount of ethylene units or said alpha-olefin units or of ethylene and said alpha-olefin units when both are present in the composition is from 15 to 35%. The total content of ethylene or $C_4$–$C_8$ alpha-olefin or combination thereof in (b+c) is less than 50%, and preferably from 20% to 45%.

The composition of component (B)(4) has at least one melt peak, determined by DSC, present at temperatures higher than 120° C., and at least one peak, relative to the vitreous transition, present at temperatures from −10° C. and −35° C. In addition, the composition of (B)(4) has a flexural modulus of less than 150 MPa, generally from 20 and 100 MPa; a tensile strength at yield of from 10 to 20 MPa, elongation at break over 400%; a tension set, at 75% strain, from 20% to 50%; a Shore D hardness from 20 and 35; haze value of less than 40%, preferably less than 35%, and do not break (no brittle impact failure) when an Izod impact test is conducted at −50° C.

The $C_4$–$C_8$ alpha-olefin useful in the preparation of component (B) of the blend include butene-1, pentene-1, hexene-1, 4-methylpentene-1 and octene-1. Butene-1 is particularly preferred.

The diene, when present, is typically a butadiene, 1,4-hexadiene, 1,5-hexadiene, or ethylidene norbornene diene monomer.

The compositions of the fibers used in preparation of the nonwoven textile material of this invention are those in which from about 5 to 95% crystalline propylene polymer material, component (A), is blended with the above described olefin polymer material (B). Preferred are compositions having from 30 to 95% of component (A), and most preferably from 50 to 95%.

The propylene polymer material and the olefin polymer material useful in producing the fibers used in the nonwoven textile material of this invention are prepared by polymerization, generally by sequential polymerization in the case of the olefin polymer material, of the relevant monomers in the presence of stereospecific Ziegler-Natta catalyst system having a solid catalyst component supported on a magnesium dihalide in active form. It is essential that such solid catalyst component comprise a titanium compound having at least one halogen-titanium bond, and an electron donor compound supported on the magnesium dihalide in active form. Such catalyst systems useful in preparing the propylene polymer composition are characterized by the fact that they produce polypropylene with an isotactic index higher than 90%, preferably higher than 95%, under optimum conditions. Catalyst systems having such characteristics are well known in the patent literature. Particularly advantageous are the catalyst systems described in U.S. Pat. Nos. 4,339,054, 4,472,524 and 4,473,660 and European Patent No. 45,977.

The solid catalyst components used in these catalyst systems include, as electron donor compounds, ethers, ketones, lactones; compounds containing atoms of N, P and/or S, and esters of mono- and dicarboxylic acids. Particularly useful as electron donors are the esters of phthalic acid, such as diisobutyl-, dioctyl- and diphenylphthalate, and benzylbutylphthalate; the esters of malonic acid, such as diisobutyl- and diethylmalonate; alkyl maleates; alkyl and aryl carbonates, such as diisobutyl carbonate, ethylphenyl carbonate and diphenyl carbonate; and succinic acid esters, such as mono and diethyl succinate.

Other particularly suited electron donors are the ether compounds having the formula:

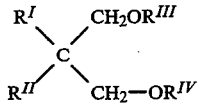

where $R^I$, $R^{II}$, are the same or different from each other, and are $C_{1-18}$ straight or branched alkyl, $C_{5-18}$ cycloalkyl or $C_{6-18}$ aryl radicals; $R^{III}$ and $R^{IV}$, are the same or different, and are $C_{1-4}$ straight or branched alkyl radicals. Typical ethers of this type and methods of preparing same are described in the U.S. Pat. No. 5,095,153, the disclosure of which is incorporated herein by reference. Examples of such ether compounds include 2-methyl-2-isopropyl-1,3-dimethoxypropane, 2,2-diisobutyl-1,3-dimethoxypropane and 2-isopropyl-2-cyclopentyl-1,3-dimethoxypropane.

The supported catalyst component can be prepared by milling a conventional anhydrous magnesium dihalide, i.e. an unactivated magnesium dihalide containing less than 1% water, the titanium compound and an electron donor compound under conditions which cause activation of the magnesium dihalide. The milled product is then treated one or more times with an excess of $TiCl_4$ at a temperature from 90° and 135° C. and washed repeatedly with a hydrocarbon (e.g. hexane) until all chlorine ions have disappeared from the wash.

Alternatively, the anhydrous magnesium halide is preactivated using known methods and then treated with an excess of $TiCl_4$ containing an electron donor compound in solution at a temperature between 80° and 135° C. The treatment with $TiCl_4$ is then repeated, and the solid is then washed with hexane or other suitable hydrocarbon solvent to eliminate all traces of unreacted $TiCl_4$. The magnesium dihalide compound or a complex thereof may be formed in situ from a magnesium compound capable of forming same upon treatment with a halide-containing titanium compound which is preferably $TiCl_4$.

In another method, the solid catalyst support may be prepared by forming an adduct, preferably in spherical particle form, of magnesium dichloride and an alcohol, such as ethanol, propanol, butanol, isobutanol and 2-ethyl-hexanol, wherein the molar ratio is 1:1 to 1:3, which then treated with an excess of $TiCl_4$ containing an electron donor in solution. The temperature ranges generally between 80° and 120° C. The solid is isolated and treated again with $TiCl_4$. The solid is separated and washed with a hydrocarbon until all chlorine ions have disappeared from the wash.

In yet another method, alkoxy magnesium compounds and alkoxy magnesium chloride compounds (the alkoxy magnesium chloride compounds being prepared according to the method described in U.S. Pat. No. 4,220,554, the disclosure of said method being incorporated herein by reference), are treated with an excess of $TiCl_4$ containing an electron donor compound in solution, under the reaction conditions described above.

In the solid catalyst component, the Ti compound, expressed as Ti, is generally present in an amount from 0.5 to 10% by weight; and the amount of electron donor compound fixed on the solid counterpart (inside donor) is generally from 5 to 20 mole % with respect to the magnesium dihalide. Useful titanium compounds for the preparation of the solid catalyst component are the halides and the alkoxy halides of titanium. Titanium tetrachloride is the preferred compound. Satisfactory results are obtained also with titanium trihalides and with alkoxy halides of titanium, such as $TiCl_3OR$ where R is a phenyl radical.

In addition to the above reactions which result in the formation of magnesium dihalides in active form, there are other reactions known in literature which result in the formation of magnesium dihalide in active form from magnesium compound other than the halides, such as alkoxy magnesium compounds and magnesium carbonate.

The active form of the magnesium dihalide in the solid catalyst component is evidenced in the X-ray spectrum of the solid catalyst component by the absence of the high intensity diffraction line which appears in the X-ray spectrum of the unactivated magnesium dihalide (having a surface area less than 3 $m^2/g$) and instead there is a halo with the maximum intensity shifted with respect to the position of the high intensity diffraction line of the unactivated magnesium dihalide, or by the fact that said high intensity diffraction line shows a broadening having a half peak breadth at least 30% greater than the one of the high intensity diffraction line of the unactivated magnesium dihalide. The most active forms are those in which the aforementioned halo appears in the X-ray spectrum of the solid catalyst component.

Magnesium dichloride is the preferred compound. In the case of the most active forms of magnesium dichloride, the X-ray spectrum of the solid catalyst component shows a halo, instead of the diffraction line which appears in the X-ray spectrum of the unactivated magnesium dichloride, at a distance of 2.56 angstroms.

The Al-alkyl compounds useful as cocatalysts include Al-trialkyls, such as Al-triethyl, Al-triisopropyl and Al-triisobutyl; Al-dialkyl ($C_{1-6}$ alkyl) hydrides, such as Al-diethyl hydride; and compounds containing two or more Al atoms linked to each other through oxygen, nitrogen and/or sulfur heteroatoms, such as:

$$(C_2H_5)_2Al—O—Al(C_2H_5)_2;$$

-continued

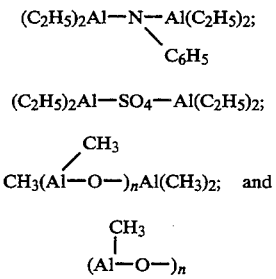

where n is a number between 1 and 20. Preferably, the Al-alkyl compound is Al-triethyl (TEAL).

Moreover, one can use $AlR_2OR'$, where R' is an aryl radical substituted in one or two positions with a $C_{1-6}$ alkyl, and R is a $C_{1-6}$ alkyl radical.

The Al-alkyl compound is generally used in an amount such that the Al/Ti ratios are from 1 to 1000.

The electron donor compounds that can be used as electron donors with the Al-alkyl compound cocatalyst include aromatic acid esters, such as alkyl benzoates, and organosilane compounds. Typical organosilane compounds are those having Si-OR, Si-OCOR or Si-$NR_2$ bonds, where R is $C_{1-20}$ alkyl, $C_{2-20}$ alkenyl, $C_{6-20}$ aryl, $C_{7-20}$ arylalkyl or $C_{5-20}$ cycloalkyl and Si (IV) as the central atom. Such compounds are described in U.S. Pat. Nos. 4,472,524, 4,522,930, 4,560,671, 4,581,342, 4,657,882 and European Patent Applications 45976 and 45977. Suitable organosilane compounds include (t-butyl)$_2$Si(OCH$_3$)$_2$, (cyclohexyl)$_2$Si(OCH$_3$)$_2$ and (phenyl)$_2$Si(OCH$_3$)$_2$.

The 1,3-diethers having the formula set forth herein above may also be used advantageously. If the inside donor is one of these diethers, the outside donor can be absent.

The polymerization of the random crystalline copolymer compositions is conducted in at least two stages such that the components (a) and (b), and optionally (c) are prepared in separate stages, operating in each subsequent stage in the presence of the polymer and the catalyst used in the preceding stage, i.e., no additional catalyst is added in the second stage.

For example, component (b) can be prepared in one stage and component (a) in a subsequent stage. The order in which components (a) and (b) are prepared is not critical.

The polymerization reactions may be conducted by batch or continuously, following known techniques, and are carried out in an inert atmosphere in the presence of liquid or gaseous monomer or combinations thereof and, optionally, in the presence of an inert hydrocarbon solvent, at a temperature generally from about 20° to about 100° C., preferably from 50° to 80° C., and at a pressure generally from about atmospheric to about 1000 psi, preferably from about 200 to 500 psi in liquid phase polymerization and typically from atmospheric to about 600 psi in gas phase polymerization. Gas phase polymerization is preferred. Typical residence times are from about 15 minutes to about 6 hours.

Hydrogen can be added as needed as a chain transfer agent for reduction in the molecular weight of the polymer.

The catalysts may be pretreated with small quantities of relevant olefin monomers (prepolymerization), maintaining the catalyst in suspension in a hydrocarbon solvent and polymerizing at a temperature of 60° C. or below for a time sufficient to produce a quantity of polymer from 0.5 to 300, preferably 50–300, times the weight of the catalyst. Prepolymerization also can be done in liquid or gaseous monomer to produce, in this case, a quantity of polymer up to 1000 times the catalyst weight.

Since the components (a) and (b), and optionally (c), are prepared directly in the polymerization, the resultant olefin polymer material compositions are in the form of as-polymerized particles. The components (A) and (B) are optimally mixed so that the resulting propylene polymer compositions are directly employable for the production of fibers without resorting to post polymerization treatments, such as granulation.

The preferred olefin polymer material are in form of spherical or spheroidal particles having diameters from 0.5 to 7 mm and more preferably with a narrow granulometric distribution wherein at least 90% of the particles have diameters from 0.5 to 5.5 mm. Such particles are obtainable, for instance, by using the catalyst systems disclosed in U.S. Pat. No. 4,472,524, the disclosures of which are incorporated herein by reference.

The crystalline propylene polymer material used in the blends of this invention is preferably a "visbroken" polymer, prepared from spherical particles as described above, having a melt flow rate (MFR, according to ASTM D-1238, measured at 230° C., 2.16 kg) of from 5 to 400, preferably from 10 to 200, and most preferably from 20 to 100, from an initial MFR of from 0.2 to 20, and preferably about 0.5 to 3.

The olefin polymer material is preferably a "visbroken" polymer having a melt flow rate (MFR, according to ASTM D-1238, measured at 230° C., 2.16 kg) of from about 5 to 1000, preferably from about 10 to 400, more preferably from about 40 to 400, except component (B)(4) wherein the preferred MFR is from 10 to 40, having an original MFR of from about 0.5 to 10, preferably about 0.5 to 3.

The MFR of the particular propylene polymer material and olefin polymer material used varies depending on the process employed to make the nonwoven. For example, when the nonwoven is prepared by a melt blown process, the MFR of the blend is generally 40 to 400, except that it is generally 10 to 40 when component (B)(4) is used.

Alternatively, component (A) and component (B) can be produced directly in the polymerization reactor to the preferred MFR. If desired, visbreaking of components (A) and (B) can be carried out separately or in the presence of each other.

The process of visbreaking the propylene polymer material (or olefin polymer material) is well known to those skilled in the art. Generally, it is carried out as follows: olefin polymer material or propylene polymer material in "as polymerized" form, e.g., flakes, powders or spheres out of the polymerization reactor or pelletized, has sprayed thereon or blended therewith, a prodegradant or free radical generating source, e.g., a peroxide in liquid or powder form or a peroxide/polypropylene concentrate, such as Xantrix 3024 peroxide concentrate available from HIMONT U.S.A., Inc. The propylene polymer material or olefin polymer material and peroxide is then introduced into a means for thermally plasticizing and conveying the mixture, e.g., an extruder at elevated temperature. Residence time and temperature are controlled in relation to the particular peroxide selected (i.e., based on the half-life of the peroxide at the process temperature of the extruder) so as to effect the desired degree of polymer chain degradation. The net result is to narrow the molecular weight distribution of the polymer as well as to reduce the overall molecular weight and thereby increase the MFR relative to the as-polymerized polymer. For example, a polymer with a fractional MFR (i.e., less than 1), or a polymer with a MFR of 0.5–10, can be selectively visbroken to a MFR of 15–50, preferably 28–42, e.g., about 35, by selection of peroxide type, extruder temperature and extruder residence time without undue experimentation. Sufficient care should be exercised in the practice of the procedure to avoid crosslinking in the presence of an ethylene-containing copolymer; typically, crosslinking can be easily avoided where the ethylene content of the copolymer is sufficiently low.

The rate of peroxide decomposition is defined in terms of half-lives, i.e. the time required at a given temperature for one-half of the peroxide molecules to decompose. It has been reported (U.S. Pat. No. 4,451,589) for example, that using Lupersol 101 peroxide under typical extruder pelletizing conditions (450° F., 2½ minutes residence time), only $2\times10^{-13}$% of the peroxide would survive pelletizing.

In general, the prodegradant should not interfere with or be adversely affected by commonly used polypropylene stabilizers and should effectively produce free radicals that upon decomposition initiate degradation of the polypropylene moiety. The prodegradant should have a short enough half-life at a polymer manufacturing extrusion temperatures, however, so as to be essentially entirely reacted before exiting the extruder. Preferably they have a half-life in the polypropylene of less than 9 seconds at 550° F. so that at least 99% of the prodegradant reacts in the molten polymer before 1 minute of extruder residence time. Such prodegradants include, by way of example and not limitation, the following: 2,5-dimethyl-2,5-bis(t-butylperoxy) hexane-3 and 4-methyl-4-t-butylperoxy-2-pentanone (e.g. Lupersol 130 and Lupersol 120 peroxides available from Lucidol Division, Penwalt Corporation),3,6,6,9,9-pentamethyl-3-(ethylacetate)-1,2,4,5,-tetraoxy cyclononane (e.g, USP-138 peroxide from Witco Chemical Corporation), and 1,1′-bis(tert-butylperoxy) diisopropyl benzene (e.g., Vulcup R peroxide from Hercules Incorporated). Preferred concentration of the free radical source prodegradants are in the range of from about 0.01 to 0.4 percent based on the weight of the polymer(s). Particularly preferred is Lupersol 101 peroxide when the peroxide is sprayed onto or mixed with the propylene polymer typically at a concentration of about 0.1 wt. % prior to their being fed to an extruder at about 230° C., for a residence time of about 2 to 3 minutes. Extrusion processes relating to the treatment of propylene-containing polymers in the presence of an organic peroxide to increase melt flow rate and reduce viscosity are known in the art and are described, e.g., in U.S. Pat. No. 3,862,265; U.S Pat. No. 4,451,589 and U.S. Pat. No. 4,578,430.

The blends of the crystalline propylene polymer material with the olefin polymer material can be prepared by physically mixing the components or by polymerizing them in a multistage sequential polymerization wherein the crystalline propylene polymer material is formed in at least one stage and the olefin polymer material in at least one other stage. The blends may be spun into fiber form by any of the usual spinning methods well known in the art. Since both materials can be heat plasticized or melted under reasonable temperature conditions, the production of the fiber is preferably done by melt spinning as opposed to solution processes.

In the process of melt spinning, the polymer is heated in an extruder to the melting point and the molten polymer is pumped at a constant rate under high pressure through a spinnerette containing a number of holes. The fluid, molten polymer streams emerge downward from the face of the spinnerette usually into a cooling stream of gas, generally air. The streams of molten polymer are solidified as a result of cooling to form filaments and are brought together and are wound up on bobbins or laid down as a web and bonded. If desirable, the polymer melt in the extruder may be protected from oxygen by blanketing it with steam or an inert gas such as carbon dioxide, nitrogen, etc.

The nonwoven textile material of the present invention can be prepared by conventional spunbonded, melt blown or carded or air laid staple fiber processes. The dimensions of the fibers used in the preparation of the nonwoven textile material of the present invention typically have a denier of less than 10 , and preferably from 2 to 4. Deniers less than 2 to 0.4 are within the broadest aspects of the invention.

Conventional additives may be blended, according to procedures known in the art, with the polymers used to produce the fibers of the nonwoven textile material of the present invention. Such additives include stabilizers, antioxidants, antislip agents, flame retardants, lubricants, fillers, coloring agents, antistatic and antisoiling agents, and the like.

The nonwoven textile materials of the present invention are useful as personal hygiene products, for example, infant care and adult incontinence products, as protective covering, for example, surgical gowns and shoe covers and other disposable medical and clothing products.

The following examples are provided to illustrate, but not limit, the invention disclosed and claimed herein.

The physical properties set forth in the Tables were measured by the following methods:

| Properties | Methods |
|---|---|
| Melt Flow Rate, g/10 min. | ASTM-D 1238, condition L |
| Tensile Strength, MD/CD | ASTM 1682 |
| Elongation at Break, % | ASTM 1682 |
| Bending Length, MD/CD | ASTM 1682 |

General Procedure

The compositions of the present invention are produced by a general procedure comprising tumble blending component (A) and component (B) set forth below in the Examples, with Lupersol 101 2,5-dimethyl-2,5-bis(t-butylperoxy) hexane, and a stabilizing package consisting of 500 ppm Irganox 1076 stabilizer and 500 ppm of calcium stearate until a homogeneous mixture is obtained, approximately 1 minute. The mixture thus obtained is pelletized by extrusion at 200° C–250° C., and the pellets are spun in a system having the following main characteristics:

extruder with a 10–175 mm diameter screw, and a length/diameter ratio of 24–32 and a polyolefin screw;

meter pump;

die temperature of 190° C.–300° C.;

air quenching system with temperatures from 10 to 20° C.;

melt draw mechanism with a rate ranging from 250 to 4000 m/min.

The nonwoven textile material is formed by depositing the fibers in a random manner on a moving porous forming belt to form a web. The web is pressed between two rolls at a temperature of from 90° C.–145° C. and a pressure of from 10 pli to 100 pli (pounds per linear inch).

Control 1

A crystalline propylene homopolymer in flake form visbroken to a MFR of 40 from an initial, as polymerized MFR of 0.4, is spun into fibers according to the procedure described above.

Control 2

A propylene homopolymer in spherical form visbroken to a MFR of 25 from an initial, as polymerized MFR of 5, is spun into fibers according to the procedure described above.

Control 3

An ethylene-propylene random copolymer having an ethylene content of 3% is visbroken to 40 MFR. Fibers of said copolymer were spun according to the general procedure described above.

Control 4

A blend prepared according to the general procedure and the ingredients of the set forth above in control 3, except that 30% of the ethylene-propylene random copolymer and 70% of the propylene homopolymer of control 2 are used and spun into fibers according to the general procedure described above.

EXAMPLE 1

Fibers comprising (A) 90% of the crystalline propylene homopolymer of control 1 described above, blended with (B) 10% of an olefin polymer material, obtained by sequential polymerization in at least two stages, containing 25% of a propylene-ethylene copolymer, (96:4 wt. ratio of polymerized units), and 75% of an ethylene-propylene copolymer, (30:70 wt. ratio of polymerized units), visbroken to 40 MFR from an initial, as polymerized MFR of 0.8, were prepared according to the general procedure described above.

EXAMPLE 2

Fibers comprising (A) 80% of the crystalline propylene homopolymer of control 1 described above, blended with (B) 20% of an olefin polymer material, obtained by sequential polymerization in two stages, containing 50% of a propylene-butene copolymer, (90:10 wt. ratio of polymerized units) formed in the first stage, and 50% of a propylene-ethylene copolymer, (95:5 wt. ratio of polymerized units) formed in the second stage, visbroken to 40 MFR from an initial, as polymerized MFR of 5, were prepared according to the general procedure described above.

EXAMPLE 3

Fibers prepared according to the general procedure and the ingredients of the blend set forth above in example 2, except that component (B), the olefin polymer material, was visbroken to a MFR of 400.

EXAMPLE 4

Fibers prepared according to the general procedure and the ingredients of the blend set forth above in example 1, except that component (A) was 90% of control 2 described above, instead of control 1 and component (B) was visbroken to a MFR of 400 instead of 40 MFR.

EXAMPLE 5

Fibers prepared according to the general procedure and the ingredients of the blend set forth above in example 4, except that the blend contained 70% of component (A) and 30% of component (B).

EXAMPLE 6

Fibers prepared according to the general procedure and the ingredients of the blend set forth above in example 2, except that component (A) was 90% of control 2 described above, instead of 80% of control 1 and 10% of component (B) was used instead of 20%.

EXAMPLE 7

Fibers prepared according to the general procedure and the ingredients of the blend set forth above in example 6, except that 70% of component (A) and 30% of component (B) was used instead of 90% component (A) and 10% of component (B) as in example 6.

EXAMPLE 8

Fibers comprising (A) 70% of control 2 described above, blended with (B) 30% of an olefin polymer material containing 4% ethylene, 90% propylene and 6% butene, visbroken to 40 MFR from an initial, as polymerized MFR of 5, were prepared according to the general procedure described above.

BONDING VS. SHRINKAGE

Figure 2:
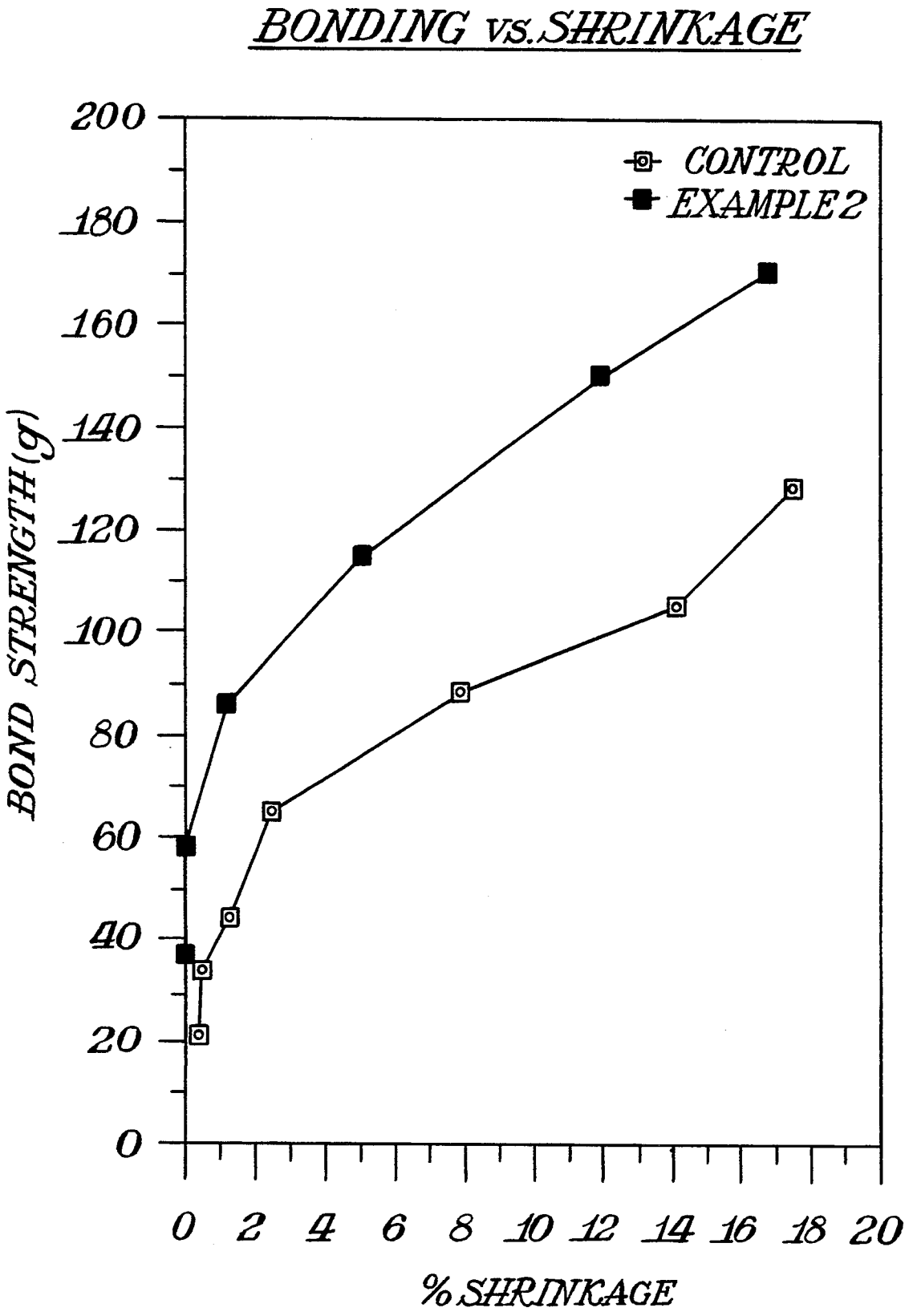
FIG. 2 is a plot showing the relationship between fiber bonding and fiber shrinkage as a function of a temperature between control 1, crystalline propylene homopolymer, and Example 2 of the present invention, a blend of 80% crystalline propylene homopolymer, and 20% an olefin polymer containing propylene-butene copolymer and 50% propylene-ethylene copolymer, visbroken to a MFR of 40.
Figure 3:
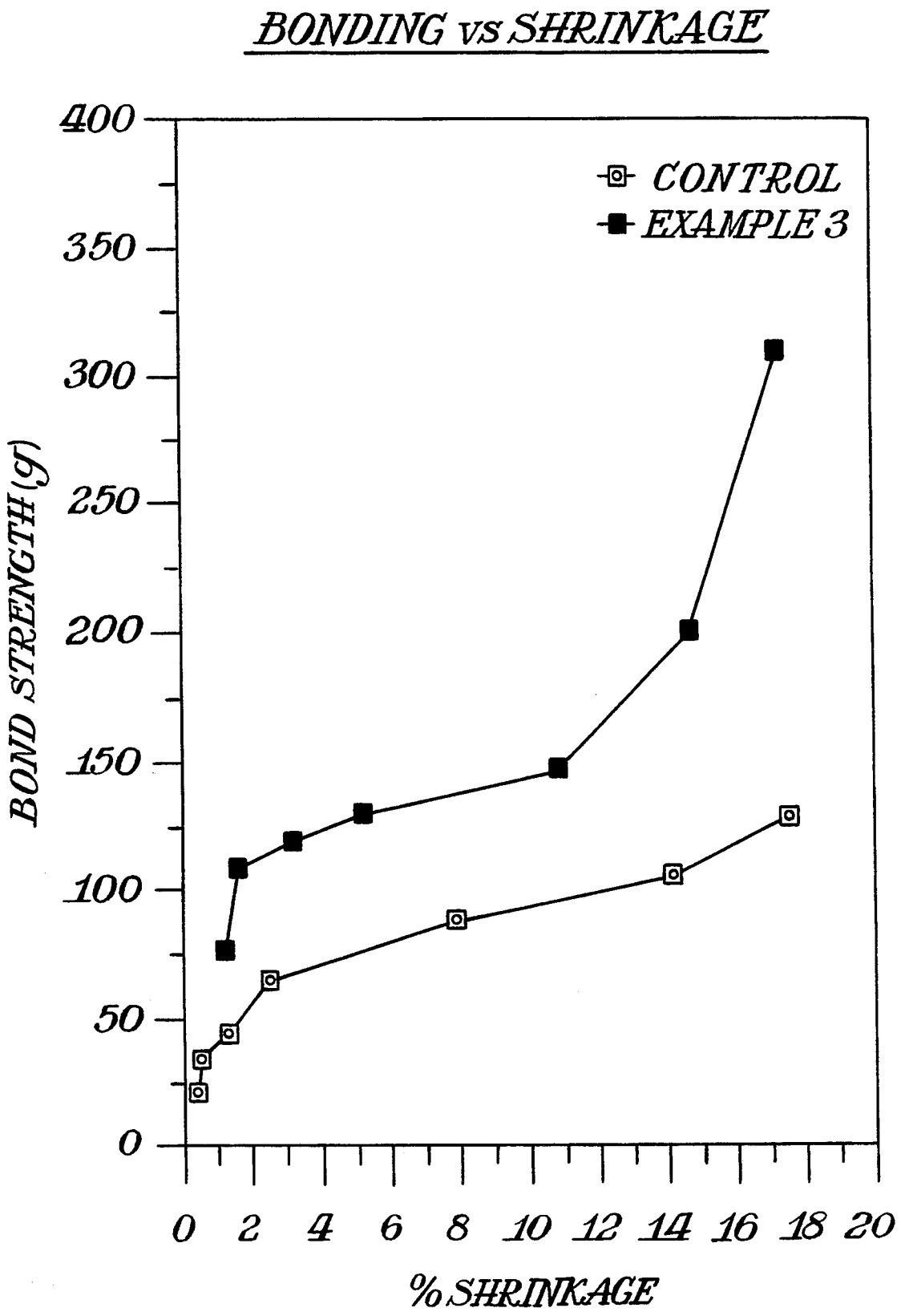
FIG. 3 is a plot showing the relationship between fiber bonding and fiber shrinkage as a function of a temperature between control 1, crystalline propylene homopolymer, and Example 3 of the present invention, a blend of 80% crystalline propylene homopolymer and 20% an olefin polymer containing 50% propylene-butene copolymer and 50% propylene-propylene copolymer, visbroken to a MFR of 400.

Illustrated in FIGS. 1–3 are plots of bonding strength (g) versus shrinkage (%) as a function of temperature from 0° C. to 160° C. These data were obtained by generating, separately, the bonding strength of the fibers as a function of temperature between 0° C.–160° C. and the shrinkage of the fibers as a function of temperature between 0° C.–160° C. Then taking the bonding value and shrinkage value at a given temperature and plotting as a (x,y) pair.

The fibers were prepared from control example 1 and examples 1–3 of the present invention in the form of a bundle of 200 filaments, having 2 denier per filament, spun and collected at 2250 m/min.

To obtain a strong fabric with good dimensional stability it is necessary to high bonding strength and low shrinkage.

In FIG. 1–3, it can be seen that the fibers prepared from the blends of the present invention have better bonding strength with less shrinkage than the fibers prepared from polypropylene of control example 1. In order for the fibers of control example 1 to obtain the same bonding strength as the fibers of the prepared with the blends of examples 1–3, the shrinkage also increases.

SPUNBOND FABRICS - SOFTNESS, DRAPABILITY AND STRENGTH

Spunbond fabrics from the polymers of Control 2–4 and Examples 4–8 of the present invention were prepared according to the general procedure described above. The softness and drapability of the fabric was measured by bending length machine direction/cross direction,(MD/CD), and overall fabric strength of the fabrics was measured by tensile strength, (MD/CD). The results are set forth below in Table I.

TABLE I

| PROPERTIES | RESINS | | | | | | | |
|---|---|---|---|---|---|---|---|---|
| | Con. 2 | Con. 3 | Con. 4 | Ex. 4 | Ex. 5 | Ex. 6 | Ex. 7 | Ex. 8 |
| Bending Length, MD/CD | | | | | | | | |
| @110° C. | 0.06/0.05 | 0.04/0.04 | 0.06/0.05 | 0.05/0.05 | 0.04/0.03 | 0.06/0.04 | 0.05/0.04 | 0.05/0.04 |
| 140° C. | 0.09/0.08 | 0.07/0.04 | 0.08/0.06 | 0.07/0.06 | 0.07/0.05 | 0.08/0.06 | 0.07/0.07 | 0.08/0.06 |
| Tensile Str., MD/CD | | | | | | | | |
| @110° C. | 4.4/2.5 | 4.0/2.7 | 4.0/3.2 | 5.4/4.6 | 4.5/3.1 | 4.1/3.2 | 4.8/3.4 | 3.7/3.0 |
| 140° C. | 5.1/2.3 | 2.1/1.1 | 3.3/2.3 | 4.5/3.7 | 3.2/2.2 | 4.2/2.8 | 3.6/3.0 | 3.4/2.8 |

As is shown in the above Table, the fabric of control 2 has good overall strength, but poor softness and drapability as demonstrated by high tensile strength values (MD/CD) and low bending length values (MD/CD); the fabric of control 3 has good softness and drapability, but poor overall strength; and no advantage was seen by blending a random copolymer with polypropylene. The fabrics of Examples 4–8 of the present invention have both improved softness and drapability, and improved overall strength as demonstrated by low bending length values and high tensile strength values.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A nonwoven textile material comprising fibers obtained from a blend of (A) 5 to 95% of a propylene polymer material selected from the group consisting of a crystalline propylene homopolymer having an isotactic index of greater than 90 and a copolymer of propylene and ethylene having an isotactic index of greater than 85 and an ethylene content of less than 10%, and (B) 95 to 5% of an olefin polymer material selected from the group consisting of:

(1) a random propylene terpolymer consisting essentially of:
  (a) from about 85 to 96% propylene,
  (b) from about 1.5 to 5% ethylene, and
  (c) from about 2.5 to 10% $C_{4-8}$ alpha-olefins;

(2) a propylene polymer composition consisting essentially of:
  (a) 30 to 65% of a copolymer of propylene with a $C_{4-8}$ alpha-olefin containing from 80 to 98% propylene, and
  (b) 35 to 70% of a co- or terpolymer of propylene with ethylene and, optionally, a $C_{4-8}$ alpha-olefin;

(3) a propylene polymer composition consisting essentially of:
  (a) 30 to 60% of linear low density polyethylene, and
  (b) from 40 to 70% of one or more crystalline copolymers of propylene with one or more comonomers selected from ethylene or $C_{4-8}$ alpha-olefins, or combinations thereof; and (4) a propylene polymer composition consisting essentially of:
  (a) from 10 to 50% of a propylene polymer having an isotactic index of greater than 80, or a copolymer of propylene with ethylene or a $C_4$–$C_8$ alpha-olefin or combinations thereof, containing over 80% propylene and having an isotactic index greater than 80,
  (b) from about 5 to 20 parts of a semi-crystalline copolymer fraction, which copolymer is insoluble in xylene at room or ambient temperature, and
  (c) from 40 to 80% of a copolymer fraction of ethylene with propylene or a $C_4$–$C_8$ alpha-olefin, and optionally with minor amounts of a diene, said copolymer fraction containing less than 40% ethylene or a $C_4$–$C_8$ alpha-olefin or combinations thereof, being soluble in xylene at room temperature and having an intrinsic viscosity from 1.5 to 4 dl/g, wherein the total of the (b) and (c) fractions, based on the total olefin polymer composition, being from about 50% to 90%, and the weight ratio of (b)/(c) being less than 0.4.

2. The nonwoven material of claim 1, wherein said fibers have a denier of less than 10.

3. The nonwoven material of claim 2, wherein the olefin polymer material (B) is (1).

4. The nonwoven material of claim 3, wherein (B)(1) is present in an amount of from 10 to 70%.

5. The nonwoven material of claim 2, wherein the olefin polymer material (B) is (2).

6. The nonwoven material of claim 5, wherein (B)(2) is present in an amount of from 10 to 70%.

7. The nonwoven material of claim 2, wherein said olefin polymer material (B) is (3).

8. The nonwoven material of claim 7, wherein (B)(3) is present in the amount of from 10 to 70%.

9. The nonwoven material of claim 2, wherein said olefin polymer material (B) is (4).

10. The nonwoven material of claim 9, wherein (B)(4) present in an amount of from 10 to 70%.

* * * * *